United States Patent [19]

Kikkawa et al.

[11] Patent Number: 4,747,548

[45] Date of Patent: May 31, 1988

[54] PROCESS FOR PRODUCING A HIGH CONCENTRATION COAL-WATER SLURRY

[75] Inventors: Hirofumi Kikkawa; Kazunori Shoji; Yasuyuki Nishimura, all of Kure, Japan

[73] Assignee: Babcock-Hitachi Kabushiki Kaisha, Tokyo, Japan

[21] Appl. No.: 931,878

[22] Filed: Nov. 17, 1986

Related U.S. Application Data

[63] Continuation of Ser. No. 627,963, Jul. 5, 1984.

[30] Foreign Application Priority Data

Jul. 5, 1983 [JP] Japan ..... 58-121043
Jul. 5, 1983 [JP] Japan ..... 57-121045

[51] Int. Cl.[4] ..... B02C 23/18

[52] U.S. Cl. ..... 241/21; 241/22; 241/29

[58] Field of Search ..... 241/14, 15, 21, 22, 241/29; 44/51

[56] References Cited

U.S. PATENT DOCUMENTS

| | | | |
|---|---|---|---|
| 2,381,351 | 8/1945 | Hardinge | 241/19 |
| 2,430,085 | 11/1947 | Spencer et al. | 241/29 X |
| 2,824,701 | 2/1958 | Vester et al. | 241/21 |
| 4,132,365 | 1/1979 | Verschuur | 241/21 |
| 4,265,407 | 5/1981 | Kessler et al. | 241/21 |
| 4,500,041 | 2/1985 | Nakkaoji et al. | 241/21 X |

FOREIGN PATENT DOCUMENTS 50412 4/1982 European Pat. Off. ..... 241/21

OTHER PUBLICATIONS

*Chemical Engineers' Handbook,* 5th Edit., R. H. Perry and C. H. Chilton, McGraw-Hill Book Co., 1973, pp. 8-8-8-11.

*Crushing and Grinding Calculations,* F. C. Bond, Allis--Chamers, 1961, pp. 1-8.

1980 *Annual Book of ASTM Standards,* Pt. 26, Gaseous Fuels; Coal and Coke; Atmospheric Analysis, American Society for Testing & Materials, 1980, pp. 229-235.

*Mineral Processing Plant Design,* A. L. Mular and R. B. Bhappu, Society of Mining Engineers, 1978, pp. 239-279.

*Primary Examiner*—Mark Rosenbaum
*Assistant Examiner*—Joseph M. Gorski
*Attorney, Agent, or Firm*—Fay, Sharpe, Beall, Fagan, Minnich & McKee

[57] ABSTRACT

A process for producing a coal-water slurry having a low viscosity and a good stability even in a high coal concentration without increase in the production cost is provided, which process is characterized in that when coal is fed to a wet mill and milled therein, the coal feed is divided in a multi-stage manner, also in that two coals of different grindabilities are milled together.

53 Claims, 5 Drawing Sheets

PROCESS FOR PRODUCING A HIGH CONCENTRATION COAL-WATER SLURRY

This application is a continuation of application Ser. No. 627,963, filed 7/5/84.

BACKGROUND OF THE INVENTION

1. Field of the Invention

This invention relates to a process for producing a high concentration coal-water slurry. More particularly it relates to a process for producing a coal-water slurry suitable for reducing its production cost.

2. Description of the Prior Art

Recently, using coal in place of expensive petroleum has become popular. However, coal in the form of a solid fuel is difficult to handle and also the cost of its transportation is great. Thus the development of techniques of converting coal into a slurry to make it possible to handle coal in the form of a fluid has been energetically carried out.

As one of the techniques, a process of COM (Coal and Oil Mixture) obtained by mixing coal with heavy oil has been known. This process, however, is directed to a mixture of coal with heavy oil in a ratio by weight of about 1:1; hence it cannot be regarded as a completely oil-free fuel and also its merit in cost is small. Further, a mixture of coal with methanol, the so-called methacoal, has been also known, but since expensive methanol is used therein, the mixture is also expensive so that it has not yet reached a stage of practical use.

On the other hand, CWM (Coal and Water Mixture) which is a mixture of coal with water is fully practical also in cost; hence it recently has been most noted. CWM, however, has a problem that if the water content therein is high, its heat efficiency at the time of combustion decrease, and contrarily if it is low, the viscosity of CWM rises to increase the pressure loss at the time of transportation. Further, since CWM consists of coal particles and water, there is a problem of storage that coal particles settle with lapse of time and separate from water. In order to overcome these problems, there has been made an attempt of adjusting the particle diameter of coal particles to thereby produce a CWM having a low viscosity and a good stability.

In order to produce a CWM slurry having a high coal concentration, a low viscosity and a good stability, it is said to be preferable to mill coal so as to give such a particle diameter distribution that the packing fraction of coal may be made as high as possible. As one of the processes for milling coal so as to give such a particle diameter distribution, a high concentration wet milling process has generally been known wherein coal is milled in a high concentration of 60–80% (% by weight; this applies to the following descriptions). However, when the coal concentration becomes so high, the viscosity of slurry also becomes high, which inevitably results in a problem of reduction in the milling efficiency, i.e. increase in the power consumed in the mill. Further, according to such a high concentration wet milling process, it is necessary for promoting the milling to add an additive such as surfactant (dispersing agent), but since the amount necessary amounts to about 1% of the weight of coal used, its influence upon the production cost of CWM cannot be neglected.

The object of the present invention is to provide a process for producing a CWM having overcome the above-mentioned drawbacks of the prior art and having a low viscosity and a good stability even in a high coal concentration without any increase in the production cost.

SUMMARY OF THE INVENTION

The present invention is characterized in that when coal is fed to a wet mill and milled therein, the feed of coal is divided in a multi-stage manner.

DESCRIPTION OF THE PREFERRED EMBODIMENTS

In the present invention, as for the process wherein the coal feed is divided in a multi-stage manner, any known optional process may be employed, and suitable examples thereof are a process of feeding coal in a multi-stage manner into one mill, a process of feeding coal into each of two or more connected mills to substantially effect a multi-stage feed, and the like.

The reason why the multi-stage milling process is employed in the present invention is as follows:

First, a bituminous coal (hereinafter referred to as coal A) having a Hardgrove grindability index (HGI, JIS-M8801) of 52 was milled by means of a tube ball mill having a diameter of 650 mm and a length of 1,250 mm to seek a relationship between Bond work index Wi and coal concentration at that time (see the following equation (1)). As a result, the results shown in FIG. 1 were obtained. Further, at that time, $F_{80}$ was, 2,830 μm and $P_{80}$ was 105 μm.

$$Wi(Kwh/\text{ton}) = \frac{\text{consumed power/treated amount}}{\frac{10}{\sqrt{P_{80}}} - \frac{10}{\sqrt{F_{80}}}} \quad (1)$$

In this equation, $F_{80}$ represents the mesh opening size (μm) of a sieve through which 80% of raw material coal passes, and $P_{80}$ represents the mesh opening size (μm) of a sieve through which 80% of milled material passes.

Figure 1:
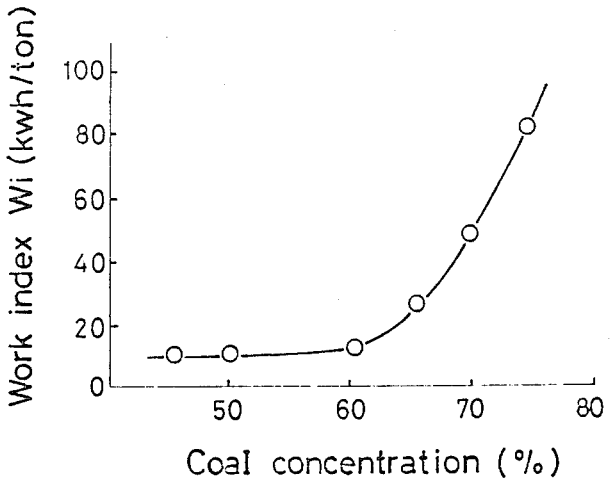
FIG. 1 showns a chart illustrating the influence of coal concentration upon coal milling efficiency.

As seen from FIG. 1, when coal A is milled, if the coal concentration exceeds 60%, the milling efficiency suddenly decreases (i.e. Wi increases); hence it is preferable to mill coal in a concentration of 60% or less. However, if the coal concentration is too low, the amount of coal required to be milled at the second stage (in other words, consumed power) increases; hence about 55 to 60% may be an otimum concentration.

Figure 2:
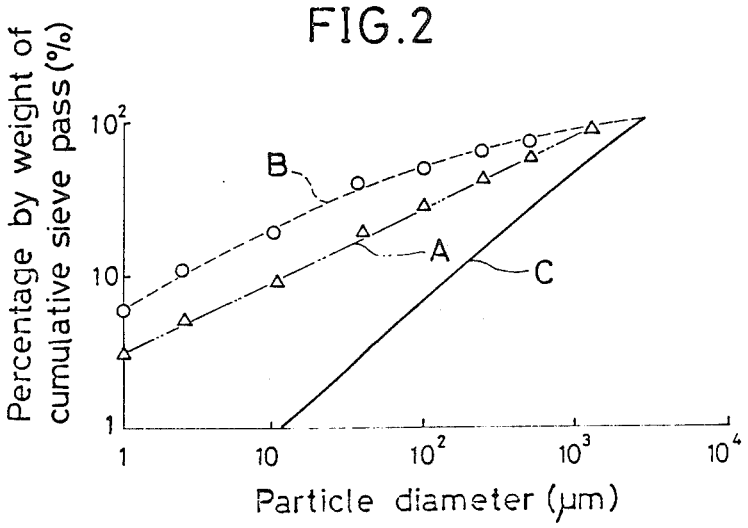
FIG. 2 shows a chart illustrating the effectiveness of a two-stage coal feed process employed in the present invention.

Next, after the above milling was carried out for an average retention time of one hour, raw material coal was separately added to give a coal concentration of 70%, followed by further milling (case B; two-stage feed process). On the other hand, a mere milling was carried out in a coal concentration of 70% for an average retention time of one hour (case A, one-stage feed process). Thereafter the coal particle diameter distributions of the respective resulting slurries in the above two cases were sought. As a result, the results shown in FIG. 2 were obtained. As seen from FIG. 2, the particle diameter distribution is broader and hence the slurry viscosity is lower in the case B (two-stage feed process) as compared with the case A (one-stage feed process). Further, it is also seen that the average particle diameter and the above $P_{80}$ are both smaller and the milling efficiency is better in the case B as compared with the case A. In addition, a symbol C in FIG. 2 represents the particle size distribution line of raw material coal shown for reference.

As described above, it is seen that when coal is fed in a multi-stage manner, it is possible to improve the milling efficiency.

The present invention will be described in more detail by way of embodiments of the present invention referring to the drawings.

Figure 3:
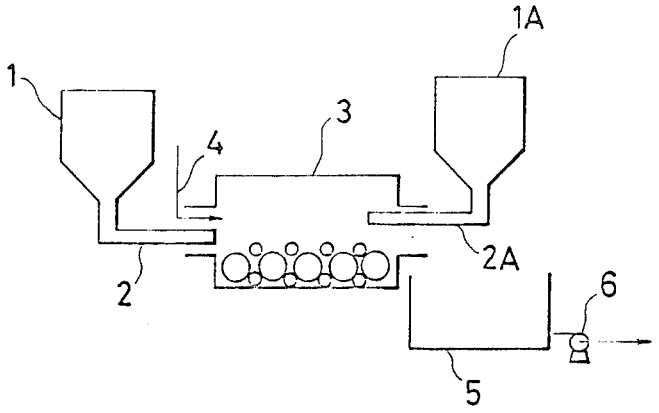
FIG. 3 shows a view illustrating the system of a two-stage coal feed type, wet ball mill suitable for carrying out the present invention.

FIG. 3 shows the system of a wet milling apparatus of two-stage coal feed type wherein one mill suitable for carrying out the present invention is employed. In this apparatus, coal stored in a bunker 1 is fed to a ball mill 3 through a feeder 2 and milled in the presence of water and an additive fed through a feed pipe 4. The coal concentration at that time varies depending on the kind of coal, but it is generally in the range of 40 to 70%, preferably 50 to 65%. The resulting coal-containing slurry obtained by the above milling is then mixed with coal fed from another bunker 1A through a feeder 2A so as to give a definite coal concentration (generally 60 to 80%), followed by further milling. After being milled to a definite particle size, the slurry is discharged from the exit of the mill 3 and stored in a slurry-adjusting tank 5, and if desired, sent to a combustion furnace, etc. by way of a pump 6. The coal fed through the feeder 2 may be in advance mixed with water and the additive, and the coal fed through the feeder 2A may be fed in either or both of the vicinity of the inlet of the mill and the vicinity of its exit.

Figure 4:
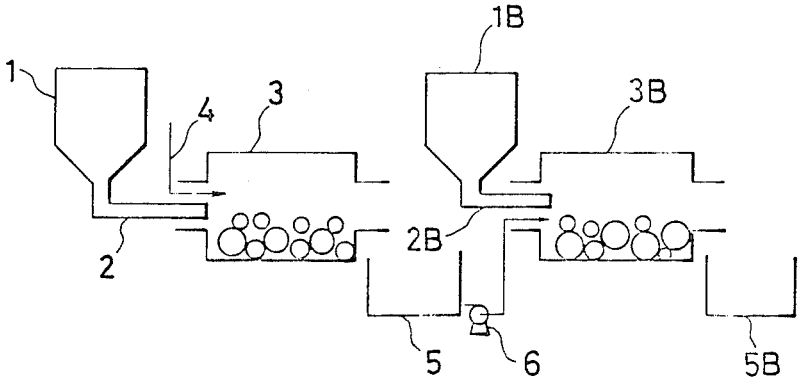
FIG. 4 shows a view illustrating the system of another two-stage coal feed type, wet ball mill suitable for carrying out the present invention.

Next, FIG. 4 shows the system of an apparatus illustrating another embodiment of the present invention. This apparatus is different from that of FIG. 3 in that in addition to the mill 3, a mill 3B provided with a bunker 1B, a feeder 2B and a slurry-adjusting vessel 5B is connected to the mill 3 by the medium of a pump to obtain a substantially two-stage coal feed structure. According to this apparatus, it is also possible to attain the effectiveness of the multi-stage milling as in the case of FIG. 3.

In the present invention, a wet mill such as web ball mill is suitable for the coal milling, but the present invention is not always limited thereto, and it is possible to carry out the multi-stage milling in combination with the wet mill with a rough grinding machine, a dry mill or the like to raise the mixing effect.

According to the embodiments shown in FIGS. 3 and 4, when the coal feed to the wet mill is divided in a multi-stage manner, it is possible to produce a coal-water slurry having a broad width of particle size distribution, capable of affording a low viscosity characteristic even in a high coal concentration, with a small amount of an additive and under a lower power, whereby it is possible to reduce the production cost of the coal-water slurry to a large extent.

In the present invention, it is preferable to mill two or more different kinds of coals having different Hardgrove index (HGI) (JIS-M8801) expressing the grindability of coal, in a mixed state thereof, the HGI value of a coal having a lower grindability of 60 or less and that having a higher grindability being larger by 8 or more, than the HGI value of the former coal having a lower grindability. Further, in order to obtain the coal-water slurry of the present invention, it is desirable to adjust the amount of water added so as to give an ultimate coal concentration in the slurry, of 60 to 80% by weight.

Figure 5:
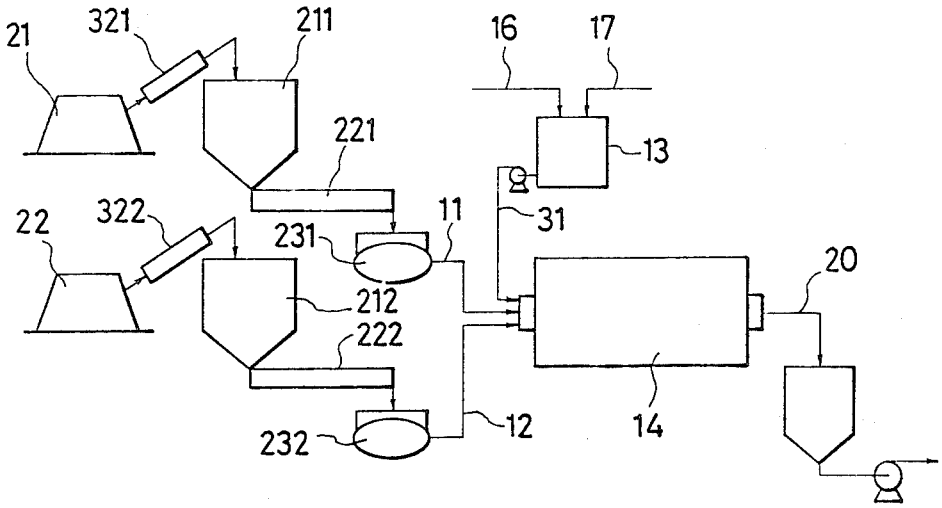
FIG. 5 shows a view illustrating the system of an apparatus employed for carrying out an embodiment of a process for producing a coal-water slurry, of the present invention wherein two different kinds of coals are used.

FIG. 5 shows a view illustrating the system of an apparatus showing an embodiment of the production process for the coal-water slurry of the present invention wherein a mixture of two different kinds of coals is used. Coal A 21 and coal B 22 are respectively roughly ground in roughly grinding machines 231, 232 after passing through conveyors 321, 322, bunkers 211, 212 and metering feeders 221, 222. After the rough grinding, coal is sent to one or a plurality of mills 14 through pipes 11, 12, and at the same time an addition liquid containing an additive such as surfactant and water is added from an addition liquid tank 13 through a feed pipe 31. After milling of coal to particles having a definite particle size distribution in the mill 14, the resulting slurry is discharged through a line 20.

Mixing process of coals having different grindabilities includes, beside the above process of mixing in the mill 14, (1) a process of mixing at a coal depot, (2) a process of mixing in a coal bunker, (3) a process of mixing in a metering feeder, (4) a process of mixing in a rough grinding machine, (5) a process of mixing after preparation of slurries, etc.

When coals having different grindabilities are mixed and wet-milled, it is possible to notably reduce the slurry viscosity as compared with a high concentration coal-water slurry produced by milling a single kind of coal to thereby prevent the energy loss, etc. at the time of transporting coal-water slurry. Further, it is also possible to reduce the power of the mill required for producing the high concentration coal-water slurry. This is advantageous from the viewpoint of energy-saving.

In the present invention, it is preferable to add to the coal-water slurry obtained by milling coal in a wet mill, further particles of a different kind of coal having a largest particle diameter of 100 μm or less or a different kind substance in an amount of 5 to 50%, preferably 20±10% based on the weight of the solids content in the slurry. These particles function as a solid lubricant in the coal-water slurry to notably promote the viscosity reduction of coal slurry.

Specifically, as for the coal particles having a largest particle diameter of 100 μm or less, pulverized coal produced during the process of coal mining or coal preparation (usually, coal recovered as sludge coal) is preferable. This carbon-containing material is composed mostly of ultrafine particles of 100 μm or less, and since it generally contains 10 to 50% of clay, it is preferable as a modifier for viscosity characteristics.

Further, as for the particles of different kinds of substance, clay substances such as kaolin, clay, etc. and inorganic salts and oxides such as calcium carbonate, silicates, silica, alumina, etc. are preferable. Addition of calcium salts such as calcium carbonate among them has a merit of desulfurization at the time of combustion in addition to the viscosity improvement.

As described above, when fine particles of a different kind coal or another different kind substance are contained in the coal slurry, it is possible to notably reduce the slurry viscosity in the same coal concentration to thereby prevent the energy loss, etc. at the time of coal slurry transportation.

The present invention will be described in more details by way of concrete Examples.

EXAMPLE 1

Coal A (a bituminous coal of HGI=52) described above was fed into the mill 3 of the apparatus shown in FIG. 3 through the feeder 2, and milled in the presence of water and an additive (anionic surfactant) fed through the feeding pipe 4, in a coal concentration of 60% and for an average retention time of one hour, followed by further milling until particles of $P_{80} \approx 105$ μm were obtained, while feeding coal through the feeder 2A so as to give a coal concentration of 70%. The work index Wi at that time was 41 (Kwh/ton), which was a far lower value than that of Wi=50 (Kwh/ton) in the case where milling was carried out while the coal concentration was maintained at 70% from the beginning. Further, the slurry viscosity in the former case of two-stage feed process was 1,500 cP, which was lower than 1,800 cP in the latter case of one-stage feed process.

In addition, in this Example, addition of only 0.7% of an anionic surfactant based on the weight of coal was sufficient. As described above, according to this Example, since a small amount of an additive used and a small power used may be sufficient, it is possible to notably reduce the production cost.

EXAMPLE 2

A slurry was produced as in Example 1, using a bituminous coal of HGI=90 (hereinafter referred to as coal B). In this Example, however, coal was first milled in a coal concentration of 65%, followed by adding coal till the concentration reached 75%. The work index Wi in the case where milling was carried out till $P_{80} \approx 105$ μm was attained, was 58 (Kwh/ton) in the case of one-stage feed, whereas it was 49 (Kwh/ton) in the case of two-stage feed, that is, a lower value. Further, the slurry viscosities at that time were 2,200 cP and 1,950 cP, respectively, that is, a reduction effectiveness of the slurry viscosity was also observed in the case of two-stage feed process.

EXAMPLE 3

A slurry was produced according to the two-stage feed process in the same manner as in Example 1 except that the amount of the surfactant added was 0.5% based on the weight of coal. The slurry viscosity at that time was 1,800 cP. Namely, in spite of the reduction in the amount of surfactant added, the resulting slurry had the same viscosity as that in the case where 0.7% of a surfactant was added in the one-stage feed process of Example 1.

EXAMPLE 4

A mixture of coal B used in Example 2 with a bituminous coal of HGI=36 (hereinafter referred to as coal C) in a ratio by weight of 1:1 was fed to a mill in a one-stage manner in a coal concentration of 70%, followed by milling it till $P_{80} \approx 105$ μm was attained. The resulting work index Wi reached as high a value as 58 (Kwh/ton). On the other hand, a slurry was produced in the same manner as in Example 1 according to the two-stage feed process except that coal C alone was first milled in a coal concentration of 54%, followed by adding coal B. The resulting work index Wi was as low a value as 45 (Kwh/ton). Further, a two-stage feed process was carried out in the same manner as above except that the order of feed of coal B and coal C was changed. The resulting work index Wi was 50 (Kwh/ton) which was somewhat higher than the above value.

EXAMPLE 5

Three kinds of coal-water slurries were produced: a coal-water slurry obtained by milling 2 kg of coal C (HGI: 49) ground to 7 mesh or less with 0.857 kg of water in a small type ball mill, a coal-water slurry obtained by milling 2 kg of coal D (HGI: 90) with 0.857 kg of water in the same ball mill as above and a coal-water slurry obtained by milling 1 kg of coal C and 1 kg of coal D with 0.857 kg of water.

Figure 6:
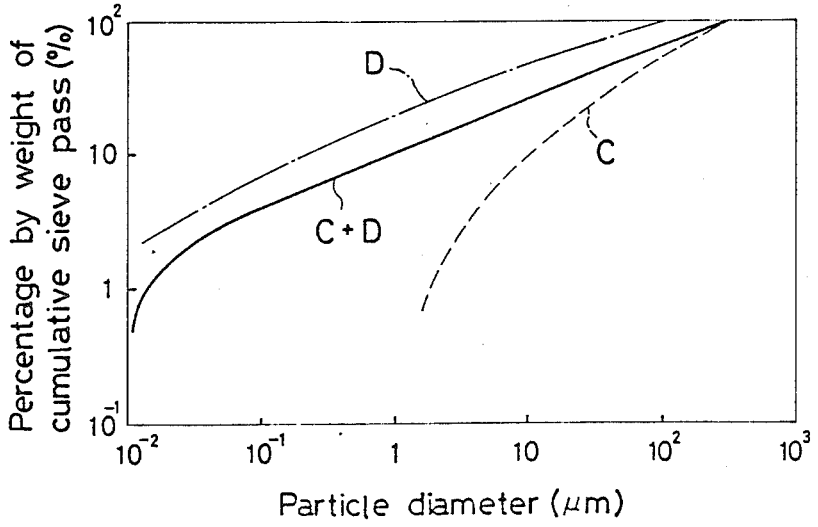
FIG. 6 shows a chart illustrating a cumulative particle diameter distribution showing the effectiveness of mixing different kinds of coals in the present invention.
Figure 7:
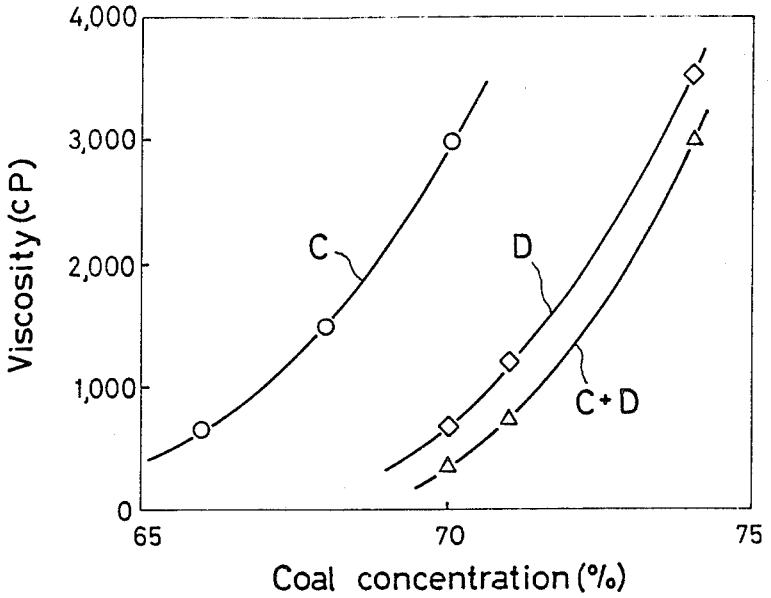
FIG. 7 shows a chart illustrating the relationship between the coal concentration and viscosity of a coal-water slurry prepared by mixing different kinds of coals.

A particle diameter distribution (C) in the case of coal C alone, a particle diameter distribution (D) in the case of coal D alone and a particle size distribution (C+D) in the case of a mixture of coal C with coal D are shown in FIG. 6. It is seen that when coal C and coal D are mixed and milled, it is possible to obtain a particle size distribution having a broader width as compared with the cases where coal C or coal D is singly milled. Further, the viscosity characteristics of (C), (D) and (C+D) are shown in FIG. 7. It is seen that when coal C and coal D are mixed and milled, the viscosity is notably reduced in the same coal concentration.

Figure 8:
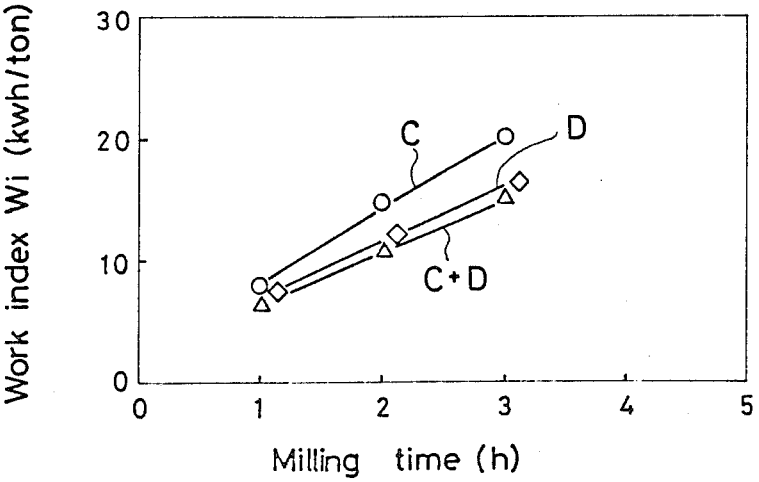
FIG. 8 shows a chart illustrating the relationship between coal milling time and work index Wi of a slurry prepared as in FIG. 7.

Further, the milling efficiencies of (C), (D) and (C+D) were compared utilizing the above-mentioned Bond work index. The results are shown in FIG. 8. It is seen that (C+D) in the case of a mixed state of coal C and coal D has a notably less work index Wi i.e. a good milling efficiency.

EXAMPLE 6

One kg of coal C (HGI: 49) ground to 7 mesh or less, 1 kg of coal E (HGI: 59) and 0.857 kg of water were milled in a small type ball mill in the same manner as in Example 5 to produce a coal-water slurry. For comparison, 1 kg of coal C (HGI: 49), coal F (HGI: 55) and 0.857 kg of water were milled in the same ball mill to produce a coal-water slurry.

Comparison of viscosities of the coal-water slurries obtained above is shown in Table 1. From this Table, it is seen that when coal C (HGI: 49) and coal E (HGI: 59) are milled in a mixed state of the two (the HGI difference being 10), a slurry having a lower viscosity is obtained (case 4), whereas when coal C (HGI: 49) and coal F (HGI: 55) are milled in a mixed state of the two (the HGI difference being 6), the resulting coal-water slurry (case 5) is hardly observed to be improved in the viscosity.

TABLE 1

| Case No. | Kind of coal | HGI | Coal concentration (%) | Slurry viscosity (cP) | Remark |
|---|---|---|---|---|---|
| 1 | C | 49 | 70 | 3,000 | |
| 2 | E | 59 | 70 | 1,200 | |
| 3 | F | 55 | 70 | 2,100 | |
| 4 | C + E | 49 + 59 | 70 | 1,100 | Example 6 |
| 5 | C + F | 49 + 55 | 70 | 2,300 | Example 6 |

EXAMPLE 7

One kg of coal E (HGI: 59) roughly ground to 7 mesh or less, 1 kg of coal G (HGI: 36) and 0.875 kg of water were milled in a small type ball mill to produce a coal-water slurry.

The viscosity of the coal (HGI difference: 23)-water slurry (case 3) obtained in a mixed state of coal E and coal G is shown in Table 2. From this Table it is also seen that when coals having different HGI values are milled in a mixed state, a coal-water slurry having a lower viscosity is obtained.

TABLE 2

| Case No. | Kind of coal | HGI | Coal concentration (%) | Slurry viscosity (cP) | Remark |
|---|---|---|---|---|---|
| 1 | E | 59 | 70 | 1,200 | |
| 2 | G | 36 | 70 | 2,800 | |
| 3 | E + G | 59 + 36 | 70 | 1,080 | Example 7 |

EXAMPLE 8

One kg of coal E (HGI: 59) roughly ground to 7 mesh or less, 1 kg of coal H (HGI: 80) and 0.78 kg of water were milled in a small type tube mill to produce a coal-water slurry. For comparison, 1 kg of coal I (HGI: 63), 1 kg of coal H (HGI: 80) and 0.78 kg of water were milled in the same small type tube mill to produce a coal-water slurry.

Comparison of viscosities of the resulting coal-water slurries is shown in Table 3. From this Table 3, it is also seen that when coal E (HGI: 59) and coal H (HGI: 80) are milled in a mixed state, a slurry having a lower viscosity is obtained (case 4). Whereas even if coal I (HGI: 63) and coal H (HGI: 80), both exceeding a HGI value of 60, are milled in a mixed state (case 5), the resulting coal-water slurry is hardly observed to be improved in the viscosity.

TABLE 3

| Case No. | Kind of coal | HGI | Coal concentration (%) | Slurry viscosity (cP) | Remark |
|---|---|---|---|---|---|
| 1 | E | 59 | 72 | 1,800 | |
| 2 | H | 80 | 72 | 1,600 | |
| 3 | I | 63 | 72 | 1,700 | |

TABLE 3-continued

| Case No. | Kind of coal | HGI | Coal concentration (%) | Slurry viscosity (cP) | Remark |
|---|---|---|---|---|---|
| 4 | E + H | 59 + 80 | 72 | 1,400 | Example 8 |
| 5 | I + H | 63 + 80 | 72 | 1,610 | |

EXAMPLE 9

Figure 9:
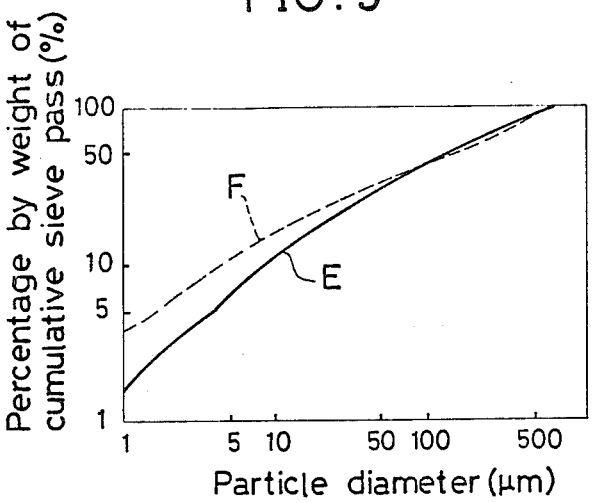
FIG. 9 shows a chart illustrating the particle diameter distributions of coal-water slurries of Wambo coal and a mixture thereof with Akahira sludge coal added thereto in the form of fine particles.
Figure 10:
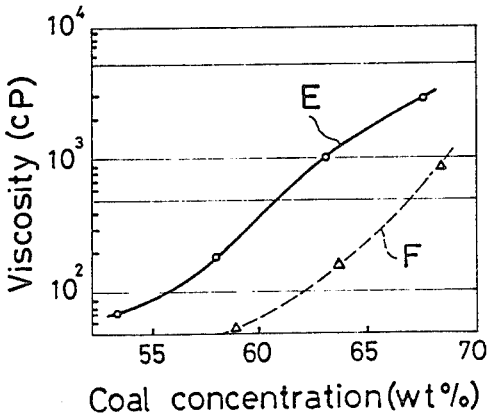
FIG. 10 shows a chart illustrating a viscosity characteristic at that time.

Fifty grams of Wambo coal E roughly ground to 28 mesh or less, and 50 g of a sample obtained by further milling the above coal in a small type ball mill were placed in a beaker. Further, to the contents was added 50 g of Akahira sludge coal F (300 mesh pass: 95%). FIG. 9 shows a particle diameter distribution (E) in the case of Wambo coal alone and a particle diameter distribution (F) after addition of Akahira sludge coal. It is seen that when Akahira sludge coal is added, the proportion of fine particles increase to give a particle diameter distribution having a broader width. Further, the viscosity characteristics of (E) and (F) are shown in FIG. 10. It is seen that when fine particles are added, the viscosity is notably reduced in the same coal concentration in the case of (F).

EXAMPLE 10

To 100 g of Wambo coal E obtained in the same manner as in Example 9 was added 20 g of kaolin ($Al_2O_3$ 30%, $SiO_2$ 60%, −300 mesh), 20 g of precipitated calcium carbonate (300 mesh pass: 99%) or 50 g of pulverized Miike coal (−300 mesh), each as fine particles, respectively. Further, water was added so as to give a solids concentration of 70%. The viscosities of the resulting coal-water slurries were measured. The results are shown in Table 4.

TABLE 4

| Component | Wambo coal (E) | Wambo coal (E) | | |
|---|---|---|---|---|
| | | Kaolin | Calcium carbonate | Miiki coal |
| Percentage addition (%) | 0 | 17 | 17 | 33 |
| Viscosity | 4,000 | 1,300 | 1,000 | 1,700 |

The effectiveness of fine particles addition on the viscosity reduction is evident from Table 4 as compared with the case of Wambo coal alone.

As described above, when fine particles of different kinds of coals or the like are contained in the coal-water slurry, it is possible to noticeably reduce the slurry viscosity to thereby prevent the energy loss, etc. at the time of the coal slurry transportation.

What we claim is:

1. A process for producing a coal-water slurry in a wet mill having a plurality of stages serially arranged to have an inlet and an exit, said process comprising:

continuously operating the wet mill for milling coal fed to the mill;

feeding coal and water to the wet mill at the plurality of stages, thereby causing concentration of the coal at the inlet to be lower than concentration of the coal at the exit of the mill;

said step of feeding includes feeding a first type of coal having a Hardgrove Index of grindability of sixty or less and feeding a second type of coal having a Hardgrove Index of grindability being greater by at least eight than the Hardgrove Index of the first type of coal; and passing the first and second types of coal and water as a coal-water slurry serially through the plurality of stages and milling the coal in the stages, thereby obtaining a broader width of particle size distribution resulting in less viscosity being obtained for the coal-water slurry than if only one type of coal was fed.

2. The process according to claim 1, further comprising:

adding a solid lubricant of coal having a largest particle diameter of up to 100 μm to the coal-water slurry at the exit of the wet mill, in an amount of 5 to 50% by weight based on weight of solids content in the slurry.

3. The process according to claim 2, wherein said step of adding adds the lubricant as one of pulverized coal and sludge coal.

4. The process according to claim 2, wherein said step of adding adds the lubricant in an amount of 10–30% by weight based on weight of solids content in the slurry.

5. The process according to claim 1, further comprising:

adding particles of a different kind of coal having a largest particle diameter of 100 microns or less, or particles of a different kind of substance selected from one of a clay and an inorganic salt to the coal-water slurry leaving the wet mill, in an amount of five to fifty percent by weight based on the weight of solids content in the slurry.

6. The process according to claim 1, wherein said step of feeding is performed in two stages, whereby concentration of the coal at the first stage is in the range of 40–70% by weight and at the second stage is 60–80% by weight.

7. The process according to claim 6, further comprised of performing said steps of feeding and milling to give a coal concentration of 60 to 80% by weight.

8. The process according to claim 6, further comprised of adjusting said feeding and milling so as to give a coal concentration at the exit of 60 to 80% by weight.

9. The process according to claim 6, wherein said step of feeding feeds the coal in a concentration of coal at the first stage in the range of 50–65% by weight.

10. The process according to claim 6, wherein said milling includes:

milling the coal fed at the first stage for about one hour prior to said feeding in the second stage; and further milling the coal fed at the first stage with the coal fed at the second stage for about one hour.

11. The process according to claim 1, further comprising adding a solid lubricant of at least one substance selected from the group consisting of kaolin, clay, calcium carbonate, silicate and alumina to the coal-water slurry at the exit of the wet mill, in an amount of 5 to 50% by weight based on weight of solids content in the slurry.

12. The process according to claim 1 wherein said milling is conducted by a ball mill.

13. The process according to claim 1, wherein said step of feeding is performed in two stages with a ratio of 1 to 1 between the weight of coal fed at the first stage to the weight of coal fed at the second stage.

14. The process according to claim 1, wherein said milling is conducted to produce coal particles at the exit with a diameter in the range of $10^{-2}$ to $10^{3}$ μm.

15. A process for producing a coal-water slurry in a wet mill, said process comprising:

continuously operating the wet mill for milling coal fed to the mill;

feeding coal and water to the wet mill;

said step of feeding including feeding a first type of coal having a Hardgrove Index of grindability of sixty or less and feeding a second type of coal having a Hardgrove Index of grindability being greater by at least eight than the Hardgrove Index of the first type of coal; and passing the first and second types of coal and water as a coal-water slurry through the mill and milling the coal, so that a broader width of particle size distribution resulting in less viscosity is obtained for the coal-water slurry than if only one type of coal was fed.

16. The process according to claim 15, wherein said feeding feeds the coal in a concentration of coal in the range of 50–65% by weight.

17. The process according to claim 15, wherein the wet mill has an exit for discharging said coal-water slurry, further comprising adding a solid lubricant of at least one substance selected from the group consisting of kaolin, clay, calcium carbonate, silicate and alumina to the coal-water slurry at the exit of the wet mill, in an amount of 5 to 50% by weight based on weight of solids content in the slurry.

18. The process according to claim 15, wherein the wet mill has an exit for discharging the coal-slurry mixture, further comprising adding a solid lubricant of coal having a largest particle diameter of up to 100 μm to the coal-water slurry at the exit of the wet mill, in an amount of 5 to 50% by weight based on weight of solids content in the slurry.

19. The process according to claim 18, wherein said step of adding adds the lubricant as one of pulverized coal and sludge coal.

20. The process according to claim 18, wherein said step of adding adds the lubricant in an amount of 10–30% by weight based on weight of solids content in the slurry.

21. The process according to claim, 15 wherein said wet mill has an exit for discharging the coal-slurry mixture, said process further comprising adding a lubricant as one of a clay substance and an inorganic salt to the coal-water slurry at the exit of the wet mill in an amount of 5 to 50% by weight based on weight of solids content in the slurry.

22. The process according to claim 15 wherein said step of milling is conducted in a ball mill.

23. The process according to claim 15, wherein said wet mill has an exit for discharging the coal-water slurry and said milling is conducted to produce coal particles at the exit with a diameter in the range of $10^{-2}$ to $10^{3}$ μm.

24. The process according to claim 15, wherein said wet mill has an exit for discharging the coal-water slurry and said steps of feeding and milling are carried out so as to give a coal concentration, at the exit of 60 to 80% by weight.

25. The process according to claim 15, further comprised of adding a particulate material to a coal-water slurry leaving the wet mill, in an amount of 5 to 50 percent by weight based on the solids content of the slurry.

26. The process according to claim 25, wherein the particulate material is a different type of coal having a maximum particle size of one hundred microns.

27. A process for producing a coal-water slurry for feeding coal into a wet mill and milling the coal therein, comprising:

feeding a first coal having a first index of grindability into a wet mill;

milling said first coal within the wet mill; and adding a second coal having a second index of grindability into the wet mill with said first coal;

wherein a lesser one of said first and second indicies is a Hardgrove Index of grindability not greater in value than sixty and the other one of said indicies is a Hardgrove Index of grindability greater in value than the value of said lesser one by eight.

28. The process according to claim 27, wherein said feeding feeds the first coal in coal in the range of 50–65% by weight.

29. The process according to claim 27, wherein the wet mill has an exit for discharging said coal-water slurry, further comprising adding a solid lubricant of at least one substance selected from the group consisting if kaolin, clay, calcium carbonate, silicate and alumina to the coal-water slurry at the exit of the wet mill, in an amount of 5 to 50% by weight based on weight of solids content in the slurry.

30. The process according to claim 27, wherein the wet mill has an exit for discharging the coal-slurry mixture, further comprising adding a solid lubricant of coal having a largest particle diameter of up to 100 μm to the coal-water slurry at the exit of the wet mill, in an amount of 5 to 50% by weight based on weight of solids content in the slurry.

31. The process according to claim 30, wherein said step of adding adds the lubricant as one of pulverized coal and sludge coal.

32. The process according to claim 30, wherein said step of adding adds the lubricant in an amount of 10–30% by weight based on weight of solids content in the slurry.

33. The process according to claim 27, wherein said wet mill has an exit for discharging the coal-clurry mixture, said process further comprising adding a lubricant as one of a clay substance and an inorganic salt to the coal-water slurry at the exit of the wet mill in an amount of 5 to 50% by weight based on weight of solids content in the slurry.

34. The process according to claim 27 wherein said milling is conducted in a ball mill.

35. The process according to claim 27, wherein said wet mill has an exit for discharging the coal-water slurry and said milling is conducted to produce coal particles at the exit with the diameter in the range of $10^{-2}$ to $10^{3}$ μm.

36. The process according to claim 27, wherein said wet mill has an exit for discharging the coal-water slurry and said feeding and milling are carried out so as to give a coal concentration, at the exit of 60 to 80% by weight.

37. The process according to claim 7, further comprised of adding a particulate material to a coal-water slurry leaving the wet mill, in an amount of 5 to 50 percent by weight based on the solids content of the slurry.

38. The process according to claim 37, wherein the particulate material is a different type of coal having a maximum particle size of one hundred microns.

39. A process for producing a coal-water slurry, comprising:

feeding two different kinds of coal having different coal graindabilities as measured by the Hardgrove Index to a wet mill, the Hardgrove Index of a first kind of the two different kinds of coal having a lower grindability being sixty or less and the Hardgrove Index of a second kind of the two different kinds of coal havinga greater grindability being larager by eight or more than the Hardgrove Index of the first kind of the coal; and grinding the two different kinds of coal in the wet mill.

40. The process according to claim 39, further comprising adding water to the two different kinds of coal and adjusting amounts of coal and water to give a coal concentration in the slurry of eighty percent by weight.

41. The process according to claim 39, comprised of feeding the coal to the wet mill at a plurality of stages.

42. The process according to claim 41, comprised of feeding the coalto give a coal concentration in a resultant coal-water slurry, or 60 to 80 percent by weight.

43. The process according to claim 41, further comprised of adding a particulate material to a coal-water slurry leaving the wet mill, in an amount of 5 to 50 percent by weight based on the solids content of the slurry.

44. The process according to claim 43, wherein the particulate material is a different type of coal having a maximum particle size of one hundred microns.

45. The process according to claim 44, wherein the different type of coal is selected from among pulvarized coal and sludge coal obtained during a coal preparation process.

46. The process according to claim 43, wherein the particulate material is selected from the group of a clay substance and an organic salt.

47. The process according to claim 39, further comprised of adding a particulate material to a coal-water slurry leaving the wet mill, in an amount of five to fifty percent by weight based on the solids content of the slurry.

48. The process according to claim 47, wherein the particulate material is a coal of a type different from said two different kinds of coal, having a maximum particle size of one hundred microns.

49. The process according to claim 48, wherein the particulate material coal is selected from the group of pulverized coal and sludge coal obtained during a coal preparation process.

50. The process according to claim 47, wherein the particulate material is selected from the group of a clay substance and an organic salt.

51. A process producing a coal-water slurry, comprising:

conveying quantities of a first coal having a first Hardgrove Index of grindability;

grinding the quantities of said first coal conveyed;

conveying quantities of a second coal having a second Hardgrove Index of grindability;

grinding the quantities of said second coal conveyed;

introducing the quantities of said first coal and said second coal into a mill after said steps of grinding;

controlling the quantities of said first coal and said second coal conveyed, and maintaining a ratio between the quantity of said first coal and the quantity of said second coal introduced into the mill;

introducing water into the mill;

said first Hardgrove Index of grindability being not more than sixty and said second Hardgrove Index being larger than said first Hardgrove Index by eight or more; and milling the quantities of said first coal and second coal introduced into the mill in the presence of water to provide a coal-slurry.

52. The process according to claim 51, further comprised of adding a particulate material to said coal-water slurry, in an amount of five to fifty percent by weight based on the solids content of the slurry.

53. The process according to claim 51, wherein the particulate matter is a third coal having a maximum particle size of one hundred microns.

* * * * *